United States Patent [19]

Pinneo

[11] Patent Number: 4,574,274

[45] Date of Patent: Mar. 4, 1986

[54] NON-CONTACT ELECTROSTATIC DEACTIVATOR

[75] Inventor: George G. Pinneo, Fort Lauderdale, Fla.

[73] Assignee: Sensormatic Electronics Corporation, Boca Raton, Fla.

[21] Appl. No.: 406,336

[22] Filed: Aug. 9, 1982

[51] Int. Cl.[4] ..... G08B 13/24

[52] U.S. Cl. ..... 340/572

[58] Field of Search ..... 340/572; 343/6.55 S, 343/6.8 R

[56] References Cited

U.S. PATENT DOCUMENTS 3,711,848 1/1973 Martens ..... 340/572
3,810,147 5/1974 Lichtblau ..... 340/572
4,063,229 12/1977 Welsh et al. .
4,318,090 3/1982 Narlow et al. ..... 340/572

*Primary Examiner*—Jerry W. Myracle
*Attorney, Agent, or Firm*—Robin, Blecker & Daley

[57] ABSTRACT

A low current electrostatic generator powers an electrode that, when proximate to the non-conductive outer surface of a surveillance tag, causes an electrostatic discharge to pass through such outer surface from the electrode and to be received by a conductive circuit within the tag. The resulting discharge impressed across the conductive circuit passes through a diode semiconductor included within such circuit to destroy the diode's unidirectional conducting characteristic and thereby deactivate the tag. No exposed conductive terminals are required on the outer surface of the surveillance tag, and the probe need not physically contact the tag to deactivate it.

10 Claims, 8 Drawing Figures

NON-CONTACT ELECTROSTATIC DEACTIVATOR

BACKGROUND OF THE INVENTION

The present invention relates to surveillance systems and apparatus used to prevent shoplifting and similar unauthorized removal of articles from a controlled area. More particularly, it relates to apparatus for deactivating a surveillance tag for authorized removal from the area.

In U.S. Pat. No. 4,063,229, issued on Dec. 13, 1977 to John Welsh and Richard N. Vaughan for "Article Surveillance", and assigned to the same assignee as the present application, there is described a system wherein sensor-emitter labels or tags containing a semiconductor diode or the like are applied to an article for the purpose of surveillance. For deactivating such tags, the patent describes various devices including, among others, radio frequency generators for burning out the diode.

Said Pat. No. 4,063,229 also describes the construction of special tags containing layers of ferrite material that can be magnetized or demagnetized by a suitable magnetic field for altering the operating characteristics of the tag and thereby deactivating the same.

A further approach to tag deactivation is shown in an "Apparatus For Deactivating A Surveillance Tag" as disclosed in U.S. Pat. No. 4,318,090, issued on Mar. 2, 1982 to Douglas A. Narlow and Eugene Stevens and also assigned to the same assignee as the present application.

Said Pat. No. 4,318,090 discloses a wand-like probe with spaced contacts arranged to be applied to and drawn along the surface of a surveillance tag that contains a diode semiconductor with exposed surface terminals. When the probe contacts engage the diode terminal, alternating current in the form of an RF signal is passed through the diode sufficient to destroy its unidirectional conducting characteristics and thereby deactivates the tag. However, production tolerances at times permit the manufacture of surveillance tags with misaligned or defective surface terminals. Such misalignment occasionally prevents the contacts of the probe described in Pat. No. 4,318,090 from conductively engaging the diode terminals, thus preventing the deactivation of the tag, an undesirable result. Moreover, the cost of these disposable tags is an important factor in their success, and the need to lessen such cost is readily apparent. The need to produce exposed external, perfectly aligned contacts on a surveillance tag increases the cost significantly.

Thus, it is an object of the present invention to overcome the disadvantages inherent in the previously known surveillance systems while actually decreasing the cost of the expendable tags utilized.

It is a further object to provide a more reliable and safer deactivating system employing a non-contact probe.

SUMMARY OF THE INVENTION

In accordance with the present invention there is provided an apparatus for deactivating a surveillance tag, the detection of which by an interrogation system is dependent upon the condition of a semiconductor contained in said tag, said apparatus comprising in combination means for generating an electrostatic charge, and means for passing said charge through said semiconductor in said tag without making direct electrically conductive contact with said tag, said charge being sufficient to degrade said semiconductor and render said tag undetectable by an interrogation station.

BRIEF DESCRIPTION OF THE DRAWINGS

The invention will be better understood after reading the following detailed description of the presently preferred embodiments thereof with reference to the appended drawings in which.

DESCRIPTION OF THE PREFERRED EMBODIMENT

Figure 1:
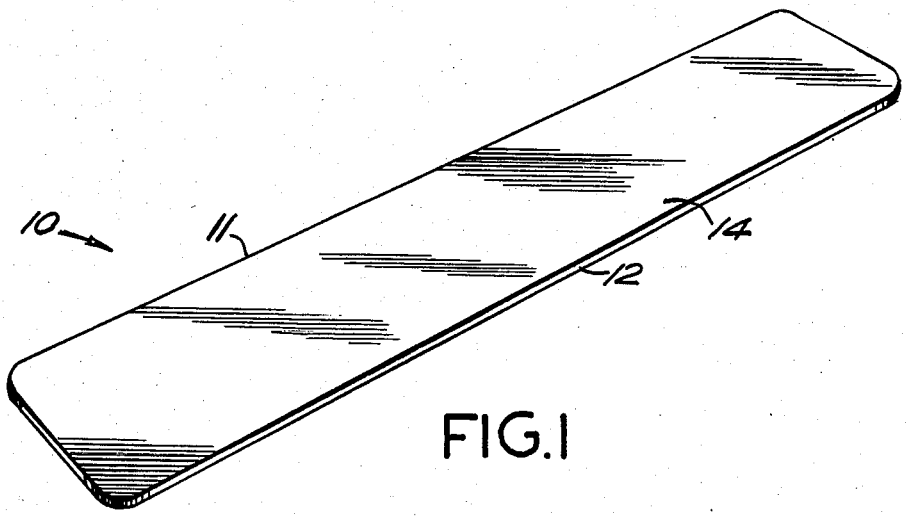
FIG. 1 is a perspective illustration of a surveillance tag of the type that can be deactivated by apparatus described hereinafter.
Figure 2:
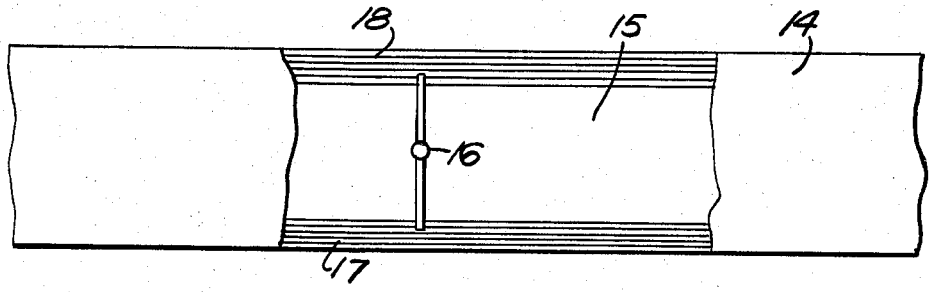
FIG. 2 is a fragmentary view with portions broken away to reveal the interior of the tag shown in FIG. 1.

Reference should now be had to the drawings wherein the same reference numerals are used throughout to designate the same or similar parts. In FIG. 1 is shown a surveillance tag, designated generally by the reference numeral 10, of thin, narrow and elongated construction with parallel side edges 11 and 12. The tag 10 is of laminated construction having an operative layer containing a semiconductor diode and interconnected foil antenna elements sandwiched between insulating layers of paper or similar material. This can be seen more clearly in FIG. 2 wherein the upper insulating layer 14 has been broken away to reveal the intermediate layer 15 with its semiconductor diode 16 joined to conductive side strips 17 and 18. As can be seen, the operative layer containing the semiconductor diode and interconnected foil antenna is entirely insulated from the tag exterior by the outer non-conductive layer 14 of the tag and no conductive terminals are exposed at the surface of such outer layer 14.

As will be apparent from the ensuing description, the details and construction of the antenna elements of the tag have no bearing on the subject invention. Similarly, diode 16 may take various forms so long as it is susceptible of being deteriorated or degraded by passing an electrostatic charge therethrough.

Figure 3:
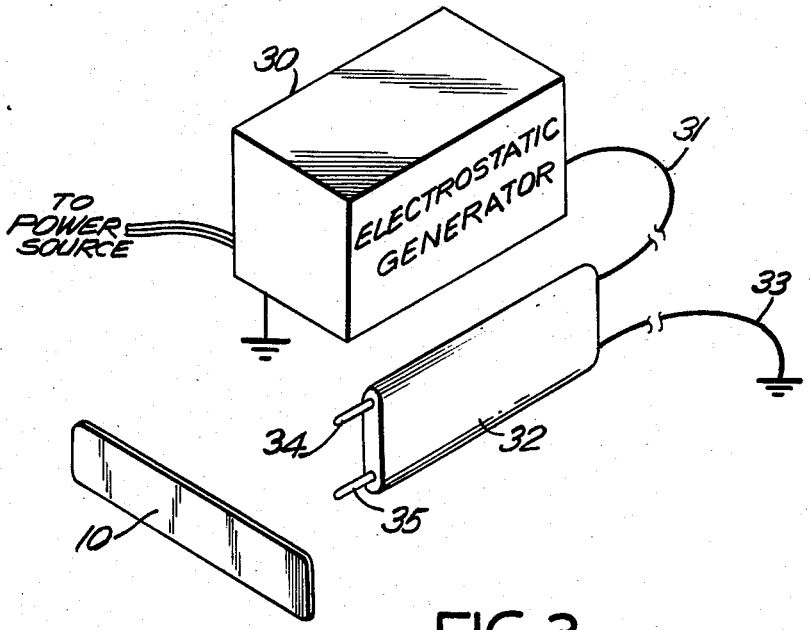
FIG. 3 is a view, partly schematic, partly in perspective, of deactivation apparatus embodying the present invention consisting of a control unit and a cable connected probe.

Reference may now be had to FIG. 3 wherein there is illustrated a deactivation apparatus embodying the present invention. It consists of an electrostatic generator 30 coupled by a flexible cable 31 to a wand-like probe 32. Cable 31 is electrically connected to probe electrode 34. Another cable 33 has one end electrically connected to a second probe electrode 35. The opposite end of cable 33 is connected to ground. When the tag, generally described as 10, is brought into proximity with the two electrodes 34 and 35, the tag completes a circuit between electrodes 34 and 35 permitting the flow of an electrostatic discharge through the diode within the tag sufficient to destroy the diode's unidirectional conducting characteristics and thereby deactivate tag 10. It should be understood that the potential between electrodes 34 and 35 should not exceed that which can cause a dielectric discharge through the surrounding air but should be sufficient to cause a discharge when the impedance between the electrodes is reduced by the introduction of the conductive and dielectric components of the tag.

Figure 4:
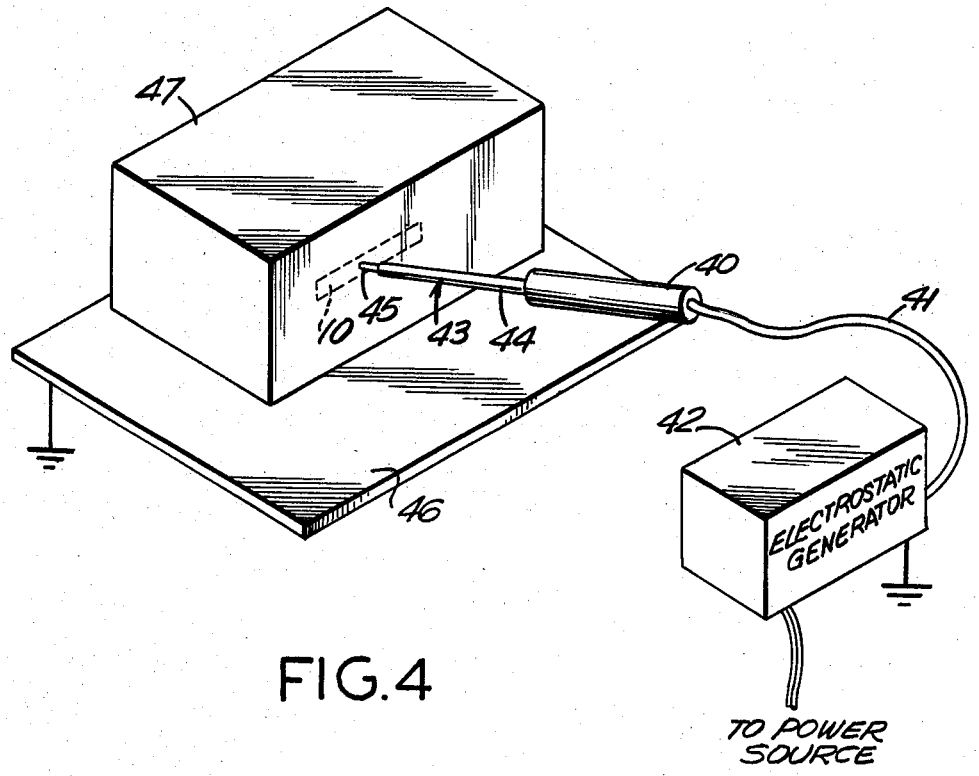
FIG. 4 shows another embodiment of the present invention that includes a ground plate and single electrode probe.

Another embodiment of the present invention is shown in FIG. 4. Probe 40 is coupled by a flexible cable 41 to electrostatic generator 42 which is connected to a power source. Probe 40 has an electrode 43 with a non-conductive sheath 44 and electrically exposed tip 45. A ground plate 46 is provided consisting of suitable conducting material such as steel. A surveillance tag 10 can be placed on a product package or other object to be sold, such as is generally depicted at 47. Both the tag 10 and package 47 may be completely covered by plastic, cardboard, or similar material. To deactivate tag 10, package 47 is placed on ground plate 46. Exposed tip 45 of probe 40 is brought near tag 10, but need not touch the tag. The tag completes the circuit to ground through package 47. The resulting electrostatic discharge which flows through the diode within tag 10 destroys its unidirectional conducting characteristics and thereby causes the tag to be undetectable by an interrogation system.

Figure 5:
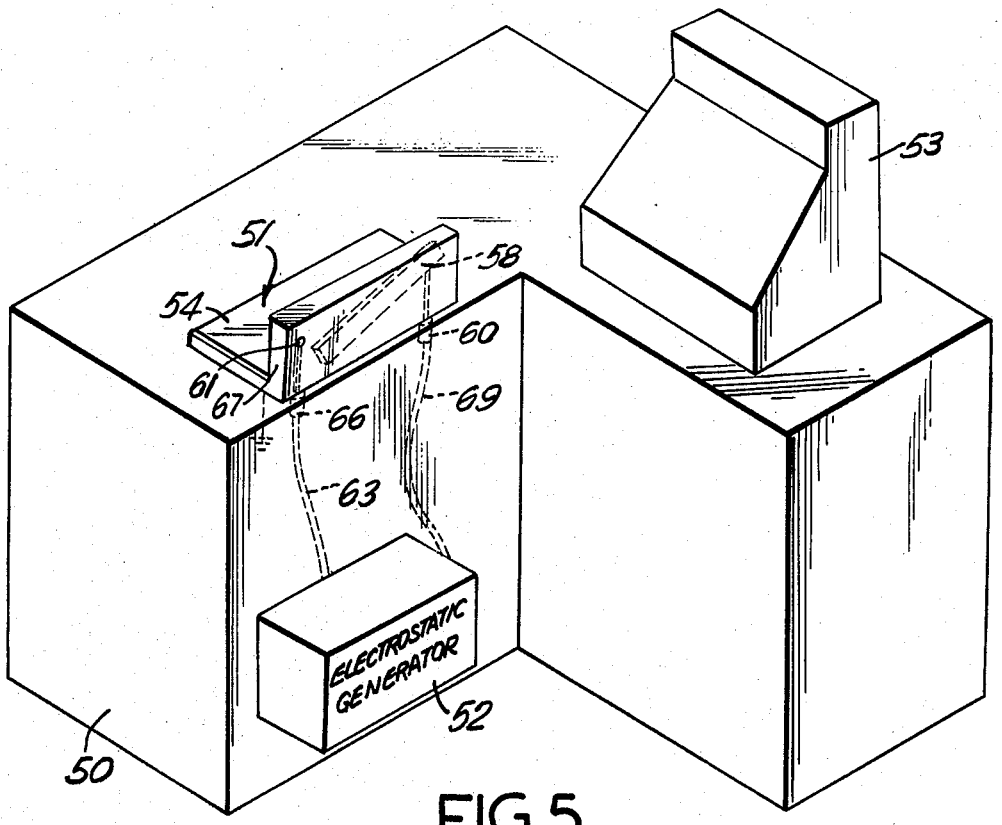
FIG. 5 is a perspective view of a check-out counter incorporating another embodiment of the present invention.
Figure 6:
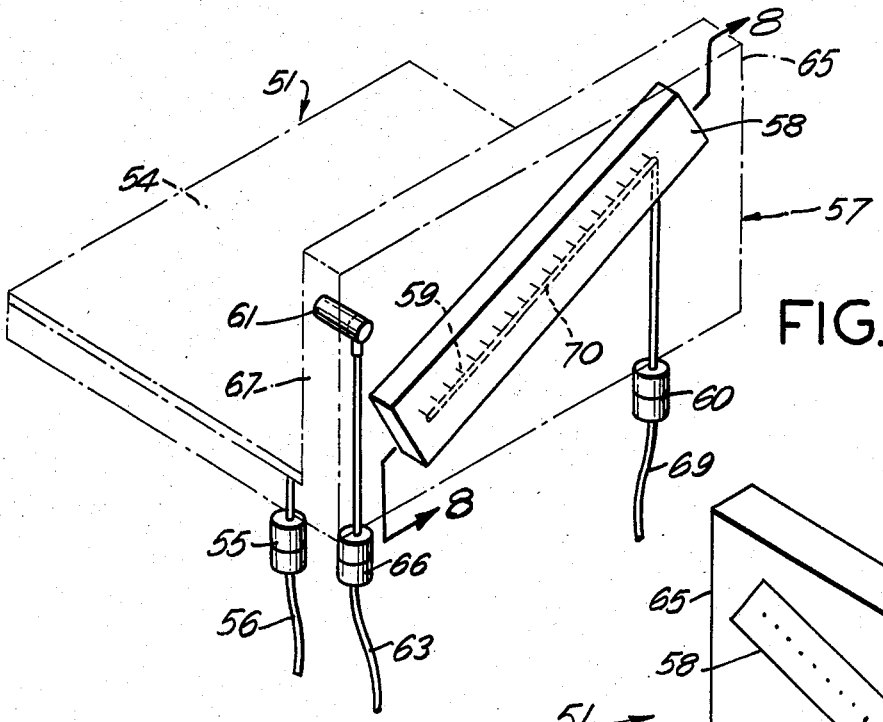
FIG. 6 is an enlarged fragmentary perspective view of the electrostatic deactivator shown in FIG. 5.
Figure 7:
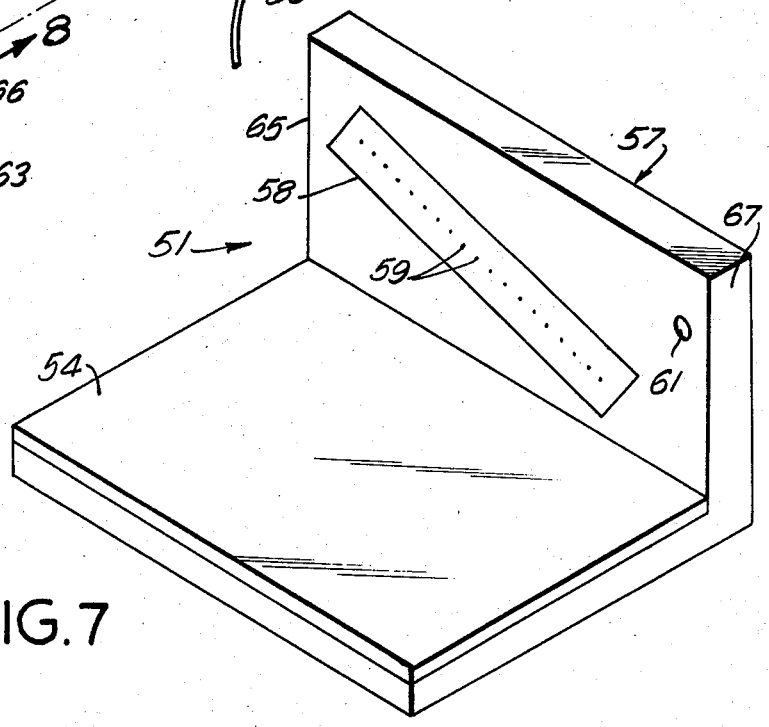
FIG. 7 is another enlarged perspective view of the electrostatic deactivator shown in FIG. 5.
Figure 8:
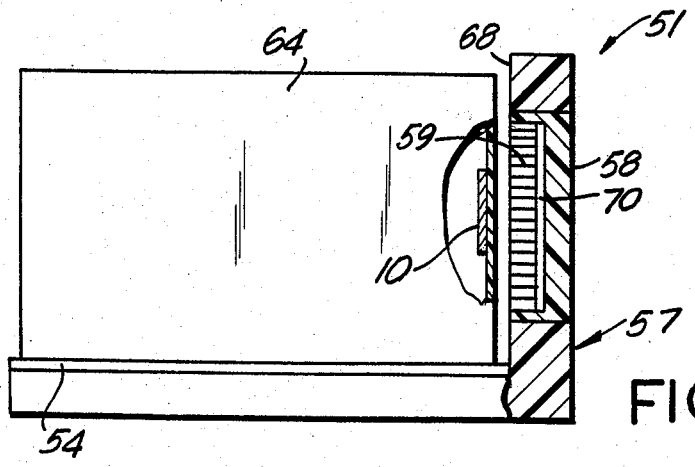
FIG. 8 is a sectional view of the electrostatic deactivator shown in FIG. 6.

Still another embodiment of the present invention may be incorporated into a checkout counter 50 as shown in FIG. 5 which includes an electrostatic deactivator 51, an electrostatic generator 52 and cash register 53. The electrostatic deactivator 51 may be better understood by reference to FIGS. 6, 7 and 8 wherein the deactivator 51 is enlarged and shown in perspective and sectional views. The deactivator 51 has a metal plate 54 which is connected to ground through connector 55 and cable 56. Insulated package guide 57 houses the diagonally positioned static discharge bar 58 whih includes multiple horizontally oriented electrode points 59 electrically connected to common conductor 70. Electrode points 59 are aimed outwardly away from wall 68 of package guide 57. The discharge bar 58 is connected by connector 60 and cable 69 to electrostatic generator 52. A photocell sensor 61 may be included in package guide 57 to sense the presence of a package placed in abutment with ground plate 54 and package guide 57. Photocell 61 is connected by connector 66 and cable 63 to generator 52 to activate generator 52 when a package or other object is present.

In operation, the embodiment of the invention shown in FIGS. 5, 6, 7 and 8 works as follows. A surveillance tag 10 is attached to package 64. Tag 10 may be placed within the plastic which seals package 64, or may even be placed under the cardboard or paper surface of package 64 so as to prevent shoplifters from becoming aware of the presence of the surveillance tag. A clerk or cashier who wishes to deactivate the tag so that a purchaser may leave the area of surveillance places the package 64 on ground plate 54 in abutment with package guide 57. The package side selected to be in abutment with package guide 57 is the one having the surveillance tag 10, such side evident because of the visual presence of tag 10 or because of markings indicating the location of the tag below the surface of an opaque material such as paper or cardboard. Package 64 is drawn along package guide 57 from end 65 of package guide 57 toward package guide end 67. When package 64 traverses photocell 61, the electrostatic discharge generator 52 is momentarily activated and energizes electrostatic discharge bar 58. Surveillance tag 10 will complete a circuit from the discharge bar 58 through package 64 to ground plate 54. The resultant discharge through tag 10 will destroy the unidirectional characteristics of the diode within tag 10 and thereby deactivate the tag.

It must be emphasized that no exposed conductive terminals need be located on the outer surface of surveillance tag 10. Moreover, the package 64 and tag 10 need not be in physical contact with package guide 57 and electrostatic discharge bar 58. The electrostatic discharge from the bar 58 to tag 10 will occur if the tag is simply within approximately one inch, or less, of discharge bar 58. Furthermore, the multiple discharge electrodes 59 of diagonally positioned bar 58 ensure completion of the circuit with the tag even when the tag is not precisely positioned in a predetermined location on the package 64. The tag can be deactivated through paper, cardboard and many types of plastics, and need not be seen by either the customer or cashier.

It has been determined that electrostatic energy of from 5–20 Kv at very low current levels is sufficient to deactivate the tag in the preferred embodiments of the present invention. Any electrostatic generator known in the art which meets the required voltage parameter for tag deactivation is suitable for use in the present invention.

While not shown in FIGS. 5–8, it will be understood that the electrostatic generator 52 is connected to a suitable power supply which may be controlled by photocell 61.

Having described the subject invention with reference to the presently preferred embodiments thereof it will be understood that various changes may be made in the construction of the apparatus and system without departing from the true spirit of the invention as defined in the appended claims.

What is claimed is:

1. Apparatus for deactivating a surveillance tag, the detection of which by an interrogation station is dependent upon the condition of a semiconductor contained in said tag, said apparatus comprising an electrode, a source of electrostatic energy coupled thereto for energizing said electrode, and means for establishing an electric current return path to said source, said electrode and means being disposed for association with said surveillance tag such as to cause an electrostatic discharge between said electrode and means through said semiconductor in said tag sufficient to degrade said semiconductor and render said tag undetectable by said interrogation station.

2. Apparatus for deactivating a surveillance tag, the detection of which by an interrogation station is dependent upon the condition of a semiconductor contained in said tag, said apparatus comprising an electrode, a source of electrostatic energy coupled thereto for energizing said electrode, and means for establishing an electric current return path to said source, said electrode and means being disposed for association with said surveillance tag such as to cause an electrostatic discharge between said electrode and means through said semiconductor in said tag sufficient to degrade said semiconductor and render said tag undetectable by said interrogation station, wherein said electrode is a first electrode, and said means for establishing an electric current return path includes a second electrode adjacent said first electrode such as to cause said electrostatic discharge to flow from said first electrode through said surveillance tag to said second electrode when said surveillance tag is brought into proximity with said first and second electrodes.

3. Apparatus for deactivating a surveillance tag, the detection of which by an interrogation station is dependent upon the condition of a semiconductor contained in said tag, said apparatus comprising an electrode, a source of electrostatic energy coupled thereto for energizing said electrode, and means for establishing an electric current return path to said source, said electrode and means being disposed for association with said surveillance tag such as to cause an electrostatic discharge between said electrode and means through said semiconductor in said tag sufficient to degrade said semiconductor and render said tag undetectable by said interrogation station, wherein said means for establishing an electric current return path includes a plate of suitably conductive material such that when said surveillance tag is disposed in the vicinity of said plate, and said electrode is brought into proximity with said surveillance tag, said electrostatic discharge flows from said electrode through said surveillance tag to said plate.

4. Apparatus according to claim 3, wherein said surveillance tag is affixed to an object such that when said object is placed on said plate, and said electrode is brought into proximity with said surveillance tag, said electrostatic discharge flows from said electrode through said surveillance tag through said object to said plate.

5. Apparatus for deactivating a surveillance tag, the detection of which by an interrogation station is dependent upon the condition of a semiconductor contained in said tag, said apparatus comprising a plurality of electrodes, a source of electrostatic energy coupled thereto for energizing said electrodes, and means for establishing an electric current return path to said source, said electrodes and means being disposed for association with said surveillance tag such as to cause an electrostatic discharge between said electrodes and means through said semiconductor in said tag sufficient to degrade said semiconductor and render said tag undetectable by said interrogation station.

6. Apparatus according to claim 5, wherein said means for establishing an electric current return path includes a plate of suitably conductive material.

7. Apparatus for deactivating a surveillance tag, the detection of which by an interrogation station is dependent upon the condition of a semiconductor contained in said tag, said apparatus comprising a plurality of electrodes, a source of electrostatic energy coupled thereto for energizing said electrodes, and means for establishing an electric current return path to said source, said electrodes and means being disposed for association with said surveillance tag such as to cause an electrostatic discharge between said electrodes and means through said semiconductor in said tag sufficient to degrade said semiconductor and render said tag undetectable by said interrogation station, said means for establishing an electic current return path includes a plate of suitably conductive material, wherein said plurality of electrodes are placed within a housing having a surface placed near said plate such that a package on which said surveillance tag is affixed thereto may be simultaneously guided along said surface of said housing and along said plate to permit said electrostatic discharge to flow from said plurality of electrodes through said surveillance tag through said package to said plate.

8. Apparatus according to claim 7, wherein said plurality of electrodes are positioned diagonally within said housing.

9. Apparatus according to claim 7, wherein a sensor means energizes said source of electrostatic energy when said sensing means perceives the presence of said package.

10. Apparatus for deactivating a surveillance tag, the detection of which is dependent upon the condition of a semiconductor contained in said tag, said apparatus comprising in combination means for generating an electrostatic charge, and means for passing said charge through said semiconductor in said tag without making direct electrically conductive contact with said tag, said charge being sufficient to degrade said semiconductor and render said tag undetectable by an interrogation station.

* * * * *